US009508329B2

(12) United States Patent
Li

(10) Patent No.: US 9,508,329 B2
(45) Date of Patent: Nov. 29, 2016

(54) METHOD FOR PRODUCING AUDIO FILE AND TERMINAL DEVICE

(71) Applicant: Huawei Technologies Co., Ltd., Shenzhen (CN)

(72) Inventor: Rui Li, Nanjing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 561 days.

(21) Appl. No.: 14/053,198

(22) Filed: Oct. 14, 2013

(65) Prior Publication Data

US 2014/0142932 A1 May 22, 2014

Related U.S. Application Data

(63) Continuation of application No. PCT/CN2013/073819, filed on Apr. 7, 2013.

(30) Foreign Application Priority Data

Nov. 20, 2012 (CN) ..... 2012 1 0471820

(51) Int. Cl.
*G10L 21/003* (2013.01)
*G10H 1/36* (2006.01)

(52) U.S. Cl.
CPC ..... *G10H 1/366* (2013.01); *G10H 2210/091* (2013.01); *G10L 21/003* (2013.01)

(58) Field of Classification Search
CPC ..... G10L 21/003; G10H 1/366
See application file for complete search history.

(56) References Cited

U.S. PATENT DOCUMENTS 4,005,270 A * 1/1977 Darwood ..... H04M 1/652 379/76
5,574,243 A * 11/1996 Nakai ..... G09B 5/04 386/240
5,663,516 A * 9/1997 Kawashima ..... G10H 1/361 434/307 A
5,875,427 A * 2/1999 Yamazaki ..... G10L 21/06 704/258
6,066,792 A * 5/2000 Sone ..... G10H 1/0041 434/307 A
6,166,314 A 12/2000 Weinstock et al.
6,224,549 B1 * 5/2001 Drongelen ..... A61B 5/00 600/300

(Continued)

FOREIGN PATENT DOCUMENTS

CN 101203904 A 6/2008
CN 102014195 A 4/2011

(Continued)

OTHER PUBLICATIONS

International Search Report and Written Opinion received in Application No. PCT/CN2013/073819 mailed Aug. 29, 2013, 12 pages.

*Primary Examiner* — Eric Yen
(74) *Attorney, Agent, or Firm* — Slater Matsil, LLP

(57) ABSTRACT

Embodiments of the present invention provide a method for producing an audio file and a terminal device. The method includes recording a user's voice to obtain audio information, generating a score curve according to the audio information, and displaying the score curve; receiving a polishing instruction that is sent by the user by operating the score curve, and adjusting the audio information according to the polishing instruction, and generating an audio file. The technical solutions provided in the present invention enable the user to create a song of himself or herself on the terminal device, thereby improving functions of the terminal device and meeting an application requirement of the user.

20 Claims, 4 Drawing Sheets

(56) References Cited

U.S. PATENT DOCUMENTS 6,262,728 B1 * 7/2001 Alexander ..... G01R 13/0245 345/440.1
6,522,345 B1 * 2/2003 Alexander ..... G01R 13/345 345/440
6,687,664 B1 * 2/2004 Sussman ..... G10L 21/04 704/200.1
6,728,680 B1 * 4/2004 Aaron ..... G10L 21/06 434/185
6,795,807 B1 * 9/2004 Baraff ..... G10L 21/0208 704/248
7,653,543 B1 * 1/2010 Blair ..... G10L 17/26 704/224
8,229,754 B1 * 7/2012 Ramirez ..... G11B 27/034 345/440
9,318,086 B1 * 4/2016 Miller ..... G10H 1/02
2001/0051870 A1 * 12/2001 Okazaki ..... G10L 21/003 704/207
2002/0039408 A1 * 4/2002 Hall ..... G06Q 10/10 379/90.01
2003/0117485 A1 * 6/2003 Mochizuki ..... G06T 13/40 348/14.01
2004/0054524 A1 * 3/2004 Baruch ..... G10L 21/00 704/201
2004/0230421 A1 * 11/2004 Cezanne ..... G10L 21/00 704/207
2005/0204904 A1 * 9/2005 Lengeling ..... G10H 1/40 84/668
2006/0230909 A1 10/2006 Song et al.
2006/0246407 A1 11/2006 Kang et al.
2007/0036297 A1 * 2/2007 Miranda-Knapp ..... G10L 21/00 379/88.19
2007/0055523 A1 * 3/2007 Yang ..... G10L 21/06 704/257
2007/0100626 A1 * 5/2007 Miller ..... G09B 21/009 704/258
2007/0118241 A1 * 5/2007 Rosenberg ..... G10H 1/053 700/94
2007/0233472 A1 * 10/2007 Sinder ..... G10L 21/00 704/219
2008/0162120 A1 * 7/2008 Mactavish ..... G10L 21/06 704/201
2008/0208599 A1 * 8/2008 Rosec ..... G10L 13/06 704/278
2008/0235025 A1 * 9/2008 Murase ..... G10L 13/033 704/260
2009/0012788 A1 * 1/2009 Gilbert ..... G10L 21/06 704/235
2009/0019995 A1 * 1/2009 Miyajima ..... G10H 1/0025 84/625
2009/0164902 A1 * 6/2009 Cohen ..... G10H 1/0025 715/716
2009/0183622 A1 * 7/2009 Parash ..... G10H 1/365 84/610
2009/0313242 A1 12/2009 Kodama
2009/0319267 A1 * 12/2009 Kurki-Suonio ..... G10L 15/265 704/235
2010/0305732 A1 12/2010 Serletic
2011/0011245 A1 * 1/2011 Adam ..... G10H 1/0066 84/612
2011/0173537 A1 * 7/2011 Hemphill ..... G06F 17/30038 715/716
2012/0312145 A1 * 12/2012 Kellett ..... G10H 1/38 84/613
2013/0019738 A1 * 1/2013 Haupt ..... G10H 1/06 84/622
2013/0110269 A1 5/2013 Nakaide et al.
2013/0132092 A1 * 5/2013 Cabezas ..... G06F 21/64 704/273
2013/0144626 A1 * 6/2013 Shau ..... G10H 1/42 704/270
2013/0231936 A1 * 9/2013 Doren ..... G10L 21/00 704/270
2014/0074479 A1 * 3/2014 Kassam ..... G10H 1/0025 704/270

FOREIGN PATENT DOCUMENTS

CN 102576524 A 7/2012
JP 2000075868 A 3/2000
WO 2012007990 A1 1/2012

* cited by examiner

METHOD FOR PRODUCING AUDIO FILE AND TERMINAL DEVICE

This application is a continuation of International Application No. PCT/CN2013/073819, filed on Apr. 7, 2013, which claims priority to Chinese Patent Application No. 201210471820.X, filed on Nov. 20, 2012, all of which are hereby incorporated herein by reference in their entireties.

TECHNICAL FIELD

The present invention relates to communications technologies, and in particular to a method for producing an audio file and a terminal device.

BACKGROUND

In the prior art, a variety of music software and song software applicable to a terminal device exist. There are mainly three types: one type is software that enables a user to directly sing and record a song, and is simply called singing software; one type is software that enables the user to search for music in a manner such as humming, and is simply called music search software; and one type is software that enables the user to play a musical instrument by hand and simulates a real musical instrument, and is simply called musical instrument playing software.

The preceding music or song software provides quite simple functions, does not support the user in creating a song of himself or herself, and therefore cannot meet an application requirement of the user.

SUMMARY OF THE INVENTION

Embodiments of the present invention provide a method for producing an audio file and a terminal device, so as to enable a user to create a song of himself or herself and therefore meet an application requirement of the user.

According to a first aspect, a method for producing an audio file is provided, including recording a user's voice to obtain audio information, generating a score curve according to the audio information, and displaying the score curve, receiving a polishing instruction that is sent by the user by operating the score curve, and adjusting the audio information according to the polishing instruction, and generating an audio file according to the adjusted audio information.

In a first possible implementation manner of the first aspect, before the recording a user's voice, the method further includes receiving a recording start instruction, and the recording a user's voice includes recording the user's voice according to the recording start instruction, and after the recording the user's voice according to the recording start instruction, the method further includes receiving a recording end instruction, and ending recording of the user's voice according to the recording end instruction.

In a second possible implementation manner of the first aspect, with reference to the first aspect or the first possible implementation manner of the first aspect, the receiving a polishing instruction that is sent by the user by operating the score curve includes receiving a pitch polishing instruction that is sent by the user by changing a fluctuation degree of the score curve, where the greater the fluctuation degree of the score curve, the higher a pitch of the audio information, and the adjusting the audio information according to the polishing instruction includes adjusting the pitch of the audio information according to the pitch polishing instruction.

In a third possible implementation manner of the first aspect, with reference to the first aspect or the first possible implementation manner of the first aspect, the receiving a polishing instruction that is sent by the user by operating the score curve includes receiving an accompaniment polishing instruction that is sent by the user by executing a preset first operation of selecting a start point of accompaniment from the score curve, and the adjusting the audio information according to the polishing instruction includes displaying information of accompaniment instruments for the user to select an accompaniment instrument for use, receiving an accompaniment instrument selection instruction sent by the user, where the accompaniment instrument selection instruction includes information of the accompaniment instrument selected by the user for use, and adding, starting from the selected start point of accompaniment and according to the information of the accompaniment instrument selected by the user for use, accompaniment information to the audio information by using a musical scale that corresponds to the accompaniment instrument selected by the user for use.

In a fourth possible implementation manner of the first aspect, with reference to the first aspect, the first possible implementation manner of the first aspect, the second possible implementation manner of the first aspect, or the third possible implementation manner of the first aspect, before the generating an audio file according to the adjusted audio information, the method includes receiving a dubbing instruction sent by the user, and adding primitive dubbing information to the audio information according to the dubbing instruction.

In a fifth possible implementation manner of the first aspect, with reference to the first aspect, the first possible implementation manner of the first aspect, the second possible implementation manner of the first aspect, the third possible implementation manner of the first aspect, or the fourth possible implementation manner of the first aspect, after the recording a user's voice to obtain audio information, the method further includes displaying an operation icon that corresponds to the audio information, and performing playing control on the audio information according to an operation performed by the user on the operation icon.

In a sixth possible implementation manner of the first aspect, with reference to the fifth possible implementation manner of the first aspect, the performing playing control on the audio information according to an operation performed by the user on the operation icon includes controlling going forward or going backward of a playing position of the audio information according to an operation that the user turns the operation icon, or controlling playing or pausing of the audio information according to an operation that the user clicks the operation icon.

In a seventh possible implementation manner of the first aspect, with reference to the first aspect, the first possible implementation manner of the first aspect, the second possible implementation manner of the first aspect, the third possible implementation manner of the first aspect, the fourth possible implementation manner of the first aspect, the fifth possible implementation manner of the first aspect, or the sixth possible implementation manner of the first aspect, after the generating a score curve according to the audio information, and displaying the score curve, the method further includes receiving a remark adding instruction that is sent by the user by executing a preset second operation of selecting a remark position from the score curve, displaying an input box for the user to enter remark content, and receiving the remark content entered by the user in the input box.

According to a second aspect, a terminal device is provided, including an obtaining module, configured to record a user's voice to obtain audio information, a score generating module, configured to generate a score curve according to the audio information, a displaying module, configured to display the score curve, a receiving module, configured to receive a polishing instruction that is sent by the user by operating the score curve, a polishing module, configured to adjust the audio information according to the polishing instruction, and an audio generating module, configured to generate an audio file according to the adjusted audio information.

In a first possible implementation manner of the second aspect, the obtaining module is further configured to receive a recording start instruction before recording the user's voice, receive a recording end instruction after recording the user's voice, and stop recording of the user's voice according to the recording end instruction.

In a second possible implementation manner of the second aspect, with reference to the second aspect or the first possible implementation manner of the second aspect, the receiving module is specifically configured to receive a pitch polishing instruction that is sent by the user by changing a fluctuation degree of the score curve, where the greater the fluctuation degree of the score curve, the higher a pitch of the audio information, and the polishing module is specifically configured to adjust the pitch of the audio information according to the pitch polishing instruction.

In a third possible implementation manner of the second aspect, with reference to the second aspect or the first possible implementation manner of the second aspect, the receiving module is specifically configured to receive an accompaniment polishing instruction that is sent by the user by executing a preset first operation of selecting a start point of accompaniment from the score curve, and receive an accompaniment instrument selection instruction sent by the user, where the accompaniment instrument selection instruction includes information of an accompaniment instrument selected by the user for use, the displaying module is further configured to display, before the receiving module receives the accompaniment instrument selection instruction, information of accompaniment instruments for the user to select the accompaniment instrument for use, and the polishing module is specifically configured to add, starting from the selected start point of accompaniment and according to the information of the accompaniment instrument selected by the user for use, accompaniment information to the audio information by using a musical scale that corresponds to the accompaniment instrument selected by the user for use.

In a fourth possible implementation manner of the second aspect, with reference to the second aspect, the first possible implementation manner of the second aspect, the second possible implementation manner of the second aspect, or the third possible implementation manner of the second aspect, the receiving module is further configured to receive, before the audio generating module generates the audio file, a dubbing instruction sent by the user, and the terminal device further includes a dubbing adding module, configured to add primitive dubbing information to the audio information according to the dubbing instruction.

In a fifth possible implementation manner of the second aspect, with reference to the second aspect, the first possible implementation manner of the second aspect, the second possible implementation manner of the second aspect, the third possible implementation manner of the second aspect, or the fourth possible implementation manner of the second aspect, the displaying module is further configured to display an operation icon that corresponds to the audio information after the obtaining module obtains the audio information, and the terminal device further includes a playing control module, configured to perform playing control on the audio information according to an operation performed by the user on the operation icon.

In a sixth possible implementation manner of the second aspect, with reference to the fifth possible implementation manner of the second aspect, the playing control module is specifically configured to control going forward or going backward of a playing position of the audio information according to the an operation that the user turns the operation icon, or the playing control module is specifically configured to control playing or pausing of the audio information according to an operation that the user clicks the operation icon.

In a seventh possible implementation manner of the second aspect, with reference to the second aspect, the first possible implementation manner of the second aspect, the second possible implementation manner of the second aspect, the third possible implementation manner of the second aspect, the fourth possible implementation manner of the second aspect, the fifth possible implementation manner of the second aspect, or the sixth possible implementation manner of the second aspect, the receiving module is further configured to receive, after the displaying module displays the score curve, a remark adding instruction that is sent by the user by executing a preset second operation of selecting a remark position from the score curve, and receive remark content entered by the user in an input box, and the displaying module is further configured to display the input box for the user to enter the remark content.

In the method for producing an audio file and the terminal device provided in the embodiments of the present invention, audio information is obtained by recording a user's voice, a score curve that corresponds to the audio information is generated, the score curve is displayed and the user is allowed to operate the score curve, the user sends a polishing instruction by operating the score curve, the audio information is adjusted according to the polishing instruction sent by the user, and an audio file is generated. The preceding process enables the user to create a song of himself or herself on the terminal device, thereby improving functions of the terminal device and meeting an application requirement of the user.

BRIEF DESCRIPTION OF THE DRAWINGS

To illustrate the technical solutions in the embodiments of the present invention more clearly, the following briefly introduces the accompanying drawings required for describing the embodiments. Apparently, the accompanying drawings in the following description show merely some embodiments of the present invention, and a person of ordinary skill in the art may still derive other drawings from these accompanying drawings without creative efforts.

DETAILED DESCRIPTION OF ILLUSTRATIVE EMBODIMENTS

To make the objectives, technical solutions, and advantages of the embodiments of the present invention more comprehensible, the following clearly describes the technical solutions in the embodiments of the present invention with reference to the accompanying drawings in the embodiments of the present invention. Apparently, the described embodiments are merely a part rather than all of the embodiments of the present invention. All other embodiments obtained by a person of ordinary skill in the art based on the embodiments of the present invention without creative efforts shall fall within the protection scope of the present invention.

To resolve a defect that existing music or song software provides quite simple functions, does not support a user in creating a song of himself or herself, and therefore cannot meet an application requirement of the user, an embodiment of the present invention provides a method for producing an audio file. The method includes recording a user's voice to obtain audio information, generating a score curve according to the audio information, and displaying the score curve, receiving a polishing instruction that is sent by the user by operating the score curve, and adjusting the audio information according to the polishing instruction, and generating an audio file according to the adjusted audio information. The preceding process enables the user to create a song of himself or herself on a terminal device, thereby improving functions of the terminal device and meeting an application requirement of the user. The following embodiment further describes the method for producing an audio file provided in the present invention.

Figure 1:
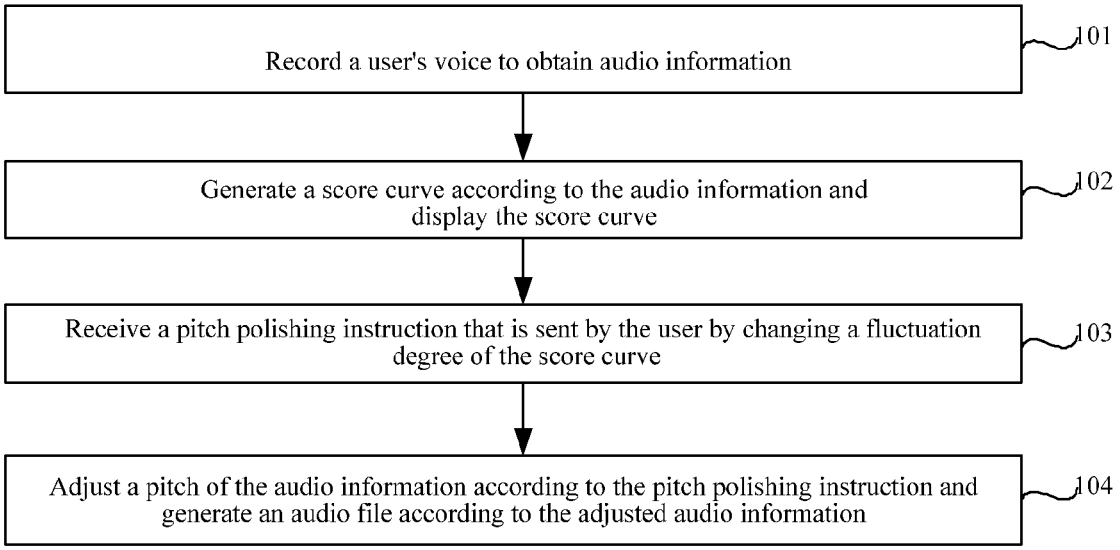
FIG. 1 is a flowchart of a method for producing an audio file according to an embodiment of the present invention.

FIG. 1 is a flowchart of a method for producing an audio file according to an embodiment of the present invention. As shown in FIG. 1, the method in this embodiment includes:

Step 101: Record a user's voice to obtain audio information.

An executor in this embodiment may be a terminal device, and may especially be various handheld devices (handheld device). A handheld device mostly refers to a handheld mobile digital product, including a smart touch-screen mobile phone, a player, a tablet computer, or the like.

In this embodiment, the user's voice mostly refers to a song hummed or sung by the user, mostly including a pitch and words of the song, but the user's voice is not yet limited to a song hummed or sung by the user. The terminal device records the user's voice to obtain audio information.

In an optional implementation manner, before the recording a user's voice, the method in this embodiment further includes: receiving, by the terminal device, a recording start instruction. The recording a user's voice includes: recording the user's voice according to the received recording start instruction. After the recording the user's voice according to the received recording start instruction, the method further includes: receiving, by the terminal device, a recording end instruction, and ending recording of the user's voice according to the recording end instruction.

The recording start instruction and the recording end instruction may be sent by the user by operating the terminal device. There may be multiple implementation manners of sending, by the user, the recording start instruction and sending the recording end instruction by operating the terminal device. For example, the user may send the recording start instruction or the recording end instruction to the terminal device by using a physical key on the terminal device. For another example, the terminal device may display a recording start icon to the user on its display screen, so that the user clicks the recording start icon on the display screen to send the recording start instruction to the terminal device; and after the user sends the recording start instruction, the terminal device displays a recording end icon to the user on its display screen, so that the user may click the recording end icon on the display screen to send the recording end instruction to the terminal device when the user hopes to end a recording process. For another example, the terminal device may further provide a recording control function in a menu manner to the user, and based on this, the user may send the recording start instruction and the recording end instruction to the terminal device by using a recording start option and a recording end option in a menu of the terminal device respectively.

Step 102: Generate a score curve according to the audio information, and display the score curve.

After obtaining the audio information, the terminal device performs a score analysis of the audio information to obtain a score curve that corresponds to the audio information, and displays the score curve to the user. For example, the terminal device may display the score curve to the user on the display screen of the terminal device. In this embodiment, the score curve may represent a pitch, a sound volume, a rhythm, or the like of the audio information. The terminal device allows the user to operate the score curve, so that the user can adjust the audio information to complete a key operation for creating a song of himself or herself.

Step 103: Receive a pitch polishing instruction that is sent by the user by changing a fluctuation degree of the score curve.

After the terminal device displays the score curve to the user, the user may send a pitch polishing instruction by operating the score curve. Optionally, the terminal device may use the fluctuation degree of the score curve to represent a pitch of the audio information. The greater the fluctuation degree of the score curve, the higher the pitch of the audio information; and on the contrary, the smaller the fluctuation degree of the score curve, the lower the pitch of the audio information. Based on this, the user may send a pitch polishing instruction to the terminal device by changing the fluctuation degree of the score curve. Accordingly, the terminal device may receive the pitch polishing instruction that is sent by the user by changing the fluctuation degree of the score curve. For example, the user may change the fluctuation degree of the score curve by pushing the score curve upward or downward.

Optionally, the user may further send a rhythm polishing instruction to the terminal device by changing a bandwidth of the score curve. Accordingly, the terminal device receives the rhythm polishing instruction that is sent by the user by changing the bandwidth of the score curve, and then adjusts a rhythm of the audio information. The greater an audio width of the score curve, the slower the rhythm of the audio information; and on the contrary, the smaller the audio width of the score curve, the faster the rhythm of the audio information. In addition, evenness of the score curve also affects the rhythm of the audio information. Therefore, the user may also change the rhythm of the audio information by adjusting the evenness of the score curve.

Optionally, the user may further send, by operating the score curve, an accompaniment polishing instruction that is used to add accompaniment to the audio information; and the terminal device adds the accompaniment information to the audio information according to the accompaniment polishing instruction. This is described in detail in a subsequent embodiment.

In addition, for existing audio information of music, the user may further send a dubbing instruction that is used to add primitive dubbing to the audio information; and the terminal device adds the primitive dubbing to the audio information according to the dubbing instruction. This is described in detail in a subsequent embodiment.

Optionally, the user may enter an edit mode by shaking or overturning the terminal device. The displaying, by the terminal device, the score curve to the user, various polishing processing of the audio information according to polishing instructions from the user, or the like are all performed in the edit mode.

Step 104: Adjust the pitch of the audio information according to the pitch polishing instruction, and generate an audio file according to the adjusted audio information.

After receiving the pitch polishing instruction, the terminal device may adjust the pitch of the audio information according to the pitch polishing instruction. For example, the terminal device may preset a mapping between fluctuation degrees of the score curve and pitches. The mapping may be represented by using a curve or a function. The terminal device acquires, according to the mapping, a pitch that corresponds to the pitch polishing instruction, and then adjusts the pitch of the audio information. For another example, the terminal device may preset a reference fluctuation degree, set a reference pitch that corresponds to the reference fluctuation degree, and also set a mapping between variation step lengths of the fluctuation degrees and variation step lengths of the pitches; and based on this, the terminal device may determine a relationship between variation quantities of the fluctuation degrees of the score curve and variation step lengths of the fluctuation degrees according to the pitch polishing instruction, further determine a pitch variation quantity, and adjust the pitch of the audio information according to the pitch variation quantity.

After adjustment of the pitch of the audio information is completed, an audio file may be generated and then production of the audio file is completed.

In this embodiment, a terminal device obtains audio information by recording a user's voice, generates a score curve that corresponds to the audio information, and displays the score curve while allowing the user to operate the score curve; the user sends a pitch polishing instruction by operating the score curve; the audio information is adjusted according to the pitch polishing instruction sent by the user; and an audio file is generated. This process enables the user to create a song of himself or herself on the terminal device, thereby improving functions of the terminal device and meeting an application requirement of the user.

Figure 2:
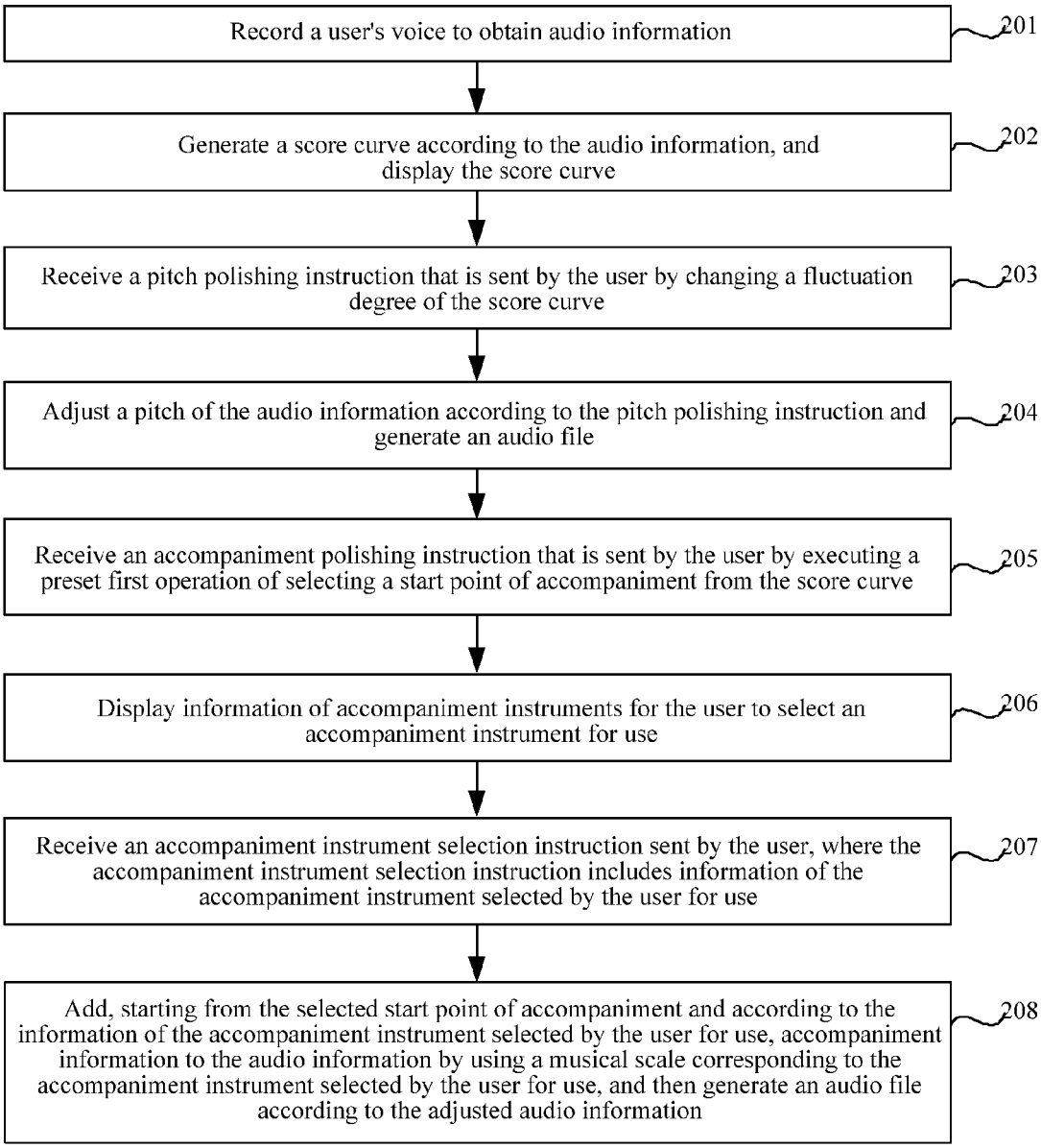
FIG. 2 is a flowchart of another method for producing an audio file according to an embodiment of the present invention.

FIG. 2 is a flowchart of another method for producing an audio file according to an embodiment of the present invention. As shown in FIG. 2, the method in this embodiment includes:

Step 201: Record a user's voice to obtain audio information.

Step 202: Generate a score curve according to the audio information, and display the score curve.

Step 203: Receive a pitch polishing instruction that is sent by the user by changing a fluctuation degree of the score curve.

Step 204: Adjust a pitch of the audio information according to the pitch polishing instruction.

Step 205: Receive an accompaniment polishing instruction that is sent by the user by executing a preset first operation of selecting a start point of accompaniment from the score curve.

Step 206: Display information of accompaniment instruments for the user to select an accompaniment instrument for use.

Step 207: Receive an accompaniment instrument selection instruction sent by the user, where the accompaniment instrument selection instruction includes information of the accompaniment instrument selected by the user for use.

Step 208: Add, starting from the selected start point of accompaniment and according to the information of the accompaniment instrument selected by the user for use, accompaniment information to the audio information by using a musical scale that corresponds to the accompaniment instrument selected by the user for use, and then generate an audio file according to the adjusted audio information.

For the preceding steps 201 to 204, reference may be made to the descriptions of steps 101 to 104, and no further details are provided herein.

In this embodiment, steps 203 to 204 are a manner of polishing the audio information by adjusting, by the terminal device, the pitch of the audio information according to a pitch polishing instruction sent by the user; whereas steps 205 to 208 describe another manner of polishing the audio information by adding, by the terminal device, accompaniment to the audio information according to an accompaniment polishing instruction sent by the user.

No sequence is defined between a process of adjusting the pitch of the audio information as described in steps 203 to step 204 and a process of adding accompaniment to the audio information as described in steps 205 to 208, as long as the two processes are completed before the audio file is generated. In this embodiment, the following is taken as an example for a description: the pitch of the audio information is adjusted before the accompaniment information is added.

Specifically, the user sends an accompaniment polishing instruction to the terminal device by executing a preset first operation of operating the score curve. For example, the user may click (single-click or double-click) a certain position of the score curve to send the accompaniment polishing instruction to the terminal device. The user-clicked position of the score curve is the start point of the accompaniment. That is, the accompaniment information is added to the audio information starting from this position. Here, clicking the score curve is the preset first operation. For another example, the user may click the score curve, the terminal device displays an options menu to the user, and the user sends the accompaniment polishing instruction to the terminal device by selecting an accompaniment polishing option. Here, the user's clicking the score curve and selecting the accompaniment polishing option from the options menu constitute the preset first operation.

After receiving the accompaniment polishing instruction sent by the user, the terminal device learns that the user needs to add the accompaniment information to the audio information, and displays information of available accompaniment instruments to the user on its display screen for the user to select an accompaniment instrument for use. Here, the information of the accompaniment instruments may be an icon of each accompaniment instrument, or a name of each accompaniment instrument, or other information that can uniquely identify each of the accompaniment instruments. Then the user may click (single-click or double-click)

the information of the accompaniment instruments to send an accompaniment instrument selection instruction to the terminal device, where the accompaniment instrument selection instruction includes the information of the accompaniment instrument selected by the user for use. After receiving the accompaniment instrument selection instruction sent by the user, the terminal device obtains, from the accompaniment instrument selection instruction, the information of the accompaniment instrument selected by the user for use; and then add, starting from the selected start point of accompaniment and according to the information of the accompaniment instrument selected by the user for use, the accompaniment information to the audio information by using a musical scale that corresponds to the accompaniment instrument selected by the user for use. Musical scales of different musical instruments are different, and musical scares that correspond to various accompaniment instruments are prestored on the terminal device. The accompaniment information is actually a kind of audio information and belongs to audio information of an accompaniment type.

After the pitch of the audio information that is obtained by recording the user's voice is adjusted and the accompaniment is added, the terminal device generates an audio file according to the processed audio information.

As can be seen from the preceding description, in this embodiment, a terminal device not only allows a user to adjust a pitch of audio information but also allows the user to add accompaniment information to the audio information, so that the user produces a more graceful and more individualized song, thereby meeting more application requirements of the user.

Figure 3:
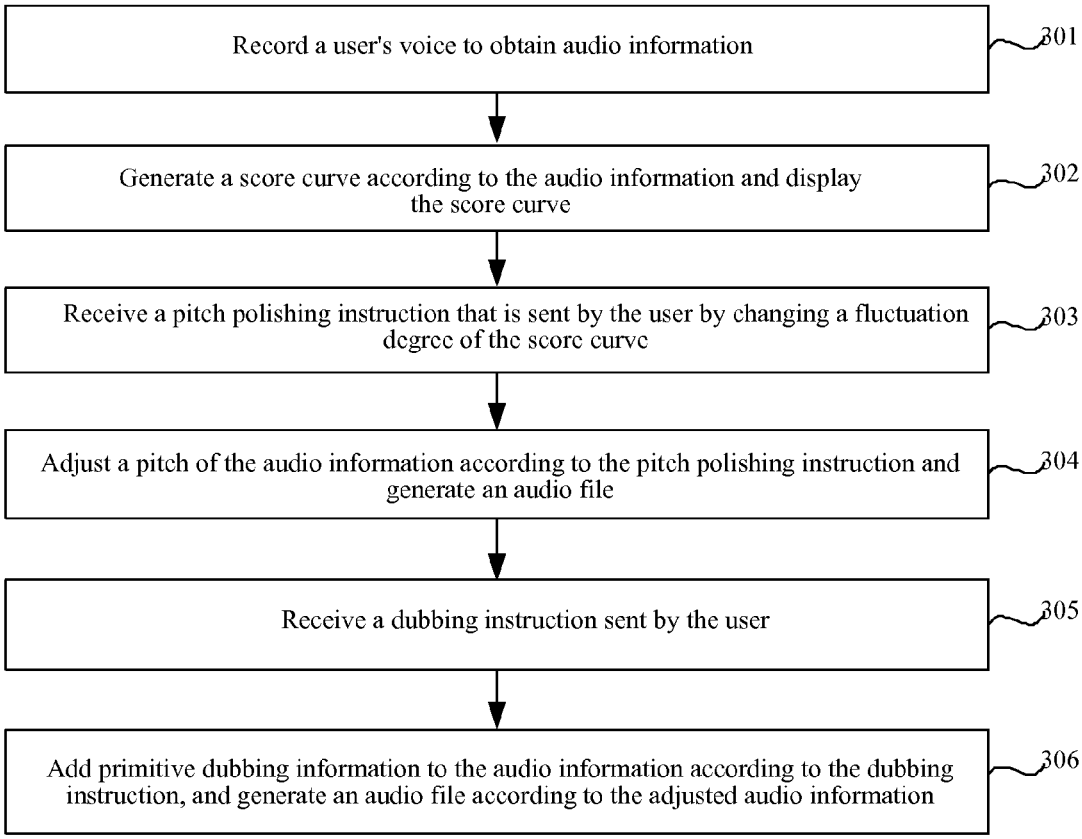
FIG. 3 is a flowchart of still another method for producing an audio file according to an embodiment of the present invention.

FIG. 3 is a flowchart of still another method for producing an audio file according to an embodiment of the present invention. As shown in FIG. 3, the method in this embodiment includes:

Step 301: Record a user's voice to obtain audio information.

Step 302: Generate a score curve according to the audio information, and display the score curve.

Step 303: Receive a pitch polishing instruction that is sent by the user by changing a fluctuation degree of the score curve.

Step 304: Adjust a pitch of the audio information according to the pitch polishing instruction.

Step 305: Receive a dubbing instruction sent by the user.

Step 306: Add primitive dubbing information to the audio information according to the dubbing instruction, and generate an audio file according to the adjusted audio information.

For the preceding steps 301 to 304, reference may be made to the descriptions of steps 101 to 104, and no further details are provided herein.

In the preceding embodiments, a song hummed or sung by the user may be an existing song or a melody randomly hummed by the user. This embodiment, however, applies in a scenario where the user hums an existing song.

In this embodiment, steps 303 to 304 are a manner of polishing the audio information by adjusting, by the terminal device, the pitch of the audio information according to a pitch polishing instruction sent by the user; whereas steps 305 to 306 describe another manner of polishing the audio information by adding, by the terminal device, primitive dubbing information to the audio information according to a dubbing instruction sent by the user. The primitive dubbing information is accompaniment information except song words carried in an existing song.

No sequence is defined between a process of adjusting the pitch of the audio information as described in steps 303 to 304 and a process of adding primitive dubbing to the audio information as described in steps 305 to 306, as long as the two processes are completed before the audio file is generated. In this embodiment, the following is taken as an example for a description: the pitch of the audio information is adjusted before the accompaniment information is added.

Specifically, the user sends a dubbing instruction to the terminal instruction. The terminal instruction learns, according to the dubbing instruction, that the user hums an existing song, and therefore, searches for primitive dubbing information of the song, and adds the primitive dubbing information to audio information that is obtained by recording the song hummed or sung by the user. Here, the primitive dubbing information is actually a kind of audio information and belongs to audio information of an accompaniment type.

There may be multiple implementation manners of sending, by the user, the dubbing instruction to the terminal device. For example, the user may send the dubbing instruction to the terminal device by using a physical key on the terminal device. For another example, the user may send the dubbing instruction to the terminal device by operating the score curve. For another example again, the terminal device may display an operation icon for operating the audio information to the user, and the user may also send the dubbing instruction to the terminal device by operating this operation icon. For another example, the terminal device may provide the user with a dubbing control function in a menu manner, and then the user may send the dubbing instruction to the terminal device by using a dubbing option in a menu of the terminal device.

Optionally, the user may further send a dubbing end instruction to the terminal device, so as to stop adding the primitive dubbing information to the audio information. Such an operation makes it possible to add the primitive dubbing information to a part of the audio information while the user may add accompaniment to the other parts of the audio information, thereby creating a more individualized song.

Optionally, after receiving the dubbing instruction, the terminal device may search a local multimedia database to obtain the primitive dubbing information of the audio information, or may search a network to obtain the primitive dubbing information of the audio information.

As can be seen from the preceding description, in this embodiment, a terminal device not only allows a user to adjust a pitch of audio information but also allows the user to add primitive dubbing information to the audio information, so that the user produces a more graceful and more individualized song, thereby meeting more application requirements of the user.

Based on the preceding embodiments, the method for producing an audio file according to the embodiment of the present invention may further include: after the audio information is obtained, displaying, by the terminal device, an operation icon that corresponds to the audio information, where the operation icon can be operated by the user to perform playing control on the audio information; and accordingly, controlling, by the terminal device, the playing of the audio information according to an operation performed by the user on the operation icon. No sequence is defined between the operation of displaying, by the terminal device, an operation icon that corresponds to the audio information, the operation of adjusting a pitch of the audio information, the operation of adding accompaniment information to the audio information, the operation of adding primitive dubbing information to the audio information, or the like.

The operation icon that corresponds to the audio information may be but not limited to an icon of a disc shape or an icon of an optical disk shape. The operation performed by the user on the operation icon includes: turning the operation icon so as to control going forward or going backward of the audio information, such as turning the operation icon clockwise to control going forward of the audio information or turning the operation icon anticlockwise to control going backward of the audio information. The user may further control playing and pausing of the audio information by clicking the operation icon, such as clicking, in a case that the audio information is not being played, the operation icon to control the playing of the audio information, or clicking, in a case that the audio information is being played, the operation icon to pause the playing of the audio information.

Based on the preceding description, the controlling, by the terminal device, the playing of the audio information according to an operation performed by the user on the operation icon includes: controlling going forward or going backward of a playing position of the audio information according to an operation that the user turns the operation icon; or controlling playing or pausing of the audio information according to an operation that the user clicks the operation icon.

The preceding process of controlling the displaying of the audio information may be combined with each process of polishing the audio information, so that a playing effect after the polishing may be auditioned to help produce a better song. For example, after adjusting the pitch of the audio information according to the pitch polishing instruction that is sent by the user by operating using the score curve, the terminal device may receive a playing instruction that is sent by the user by operating the operation icon that corresponds to the audio information, and then play the audio information after the pitch adjustment for an auditioning purpose. Optionally, if a current playing position of the audio information is different from a position where the terminal device adjusts the pitch, the user may turn the operation icon to control the going forward or going backward of the audio information, so as to locate the position where the pitch of the audio information is adjusted, thereby quickly completing the auditioning.

Based on the preceding embodiments, after the generating a score curve according to the audio information, and display the score curve, the method for producing an audio file according to the embodiment of the present invention may further include receiving, by the terminal device, a remark adding instruction that is sent by the user by executing a preset second operation of selecting a remark position from the score curve. For example, the user may click (single-click or double-click) a certain position of the score curve. The position is a position where a remark will be added, and then a remark adding instruction is sent to the terminal device through the user's clicking operation. Here, the operation of clicking the score curve is the second operation. For another example, the user may click the score curve, the terminal device displays an options menu to the user, and the user sends the remark adding instruction to the terminal device by selecting a remark adding option. Here, the user's clicking the score curve and selecting the remark adding option from the options menu constitute the second operation.

It should be noted that the second operation is different from the first operation and the user's selection of the start point of accompaniment should be differentiated from the user's selection of the remark position.

After receiving the remark adding instruction sent by the user, the terminal device displays an input box to the user for the user to enter remark content; the user enters the remark content in the input box; and then the terminal device receives the remark content entered by the user in the input box, thereby completing a process of adding a remark.

No sequence is defined between the operation of adding a remark on the score curve, the operation of displaying an operation icon, the operation of adjusting a pitch of the audio information, the operation of adding accompaniment information to the audio information, the operation of adding primitive dubbing information to the audio information, or the like.

Further, the method for producing an audio file according to the embodiment of the present invention further includes: sending, by the terminal device, the produced audio file to another terminal device such as a terminal device of a friend of the user so as to implement audio file sharing.

As can be seen from the preceding description, in the method for producing an audio file according to the embodiment of the present invention, a terminal device allows a user to produce a song of himself or herself and allows the user to perform various polishing processing for the song produced by himself or herself, so that a more colorful and more individualized song is produced while functions of the terminal device are improved, thereby meeting an application requirement of the user.

Figure 4:
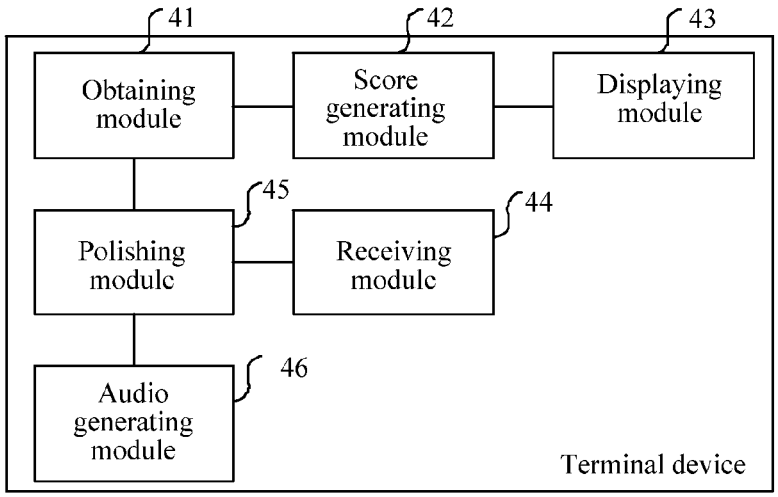
FIG. 4 is a schematic structural diagram of a terminal device according to an embodiment of the present invention.

FIG. 4 is a schematic structural diagram of a terminal device according to an embodiment of the present invention. As shown in FIG. 4, the terminal device in this embodiment includes: an obtaining module 41, a score generating module 42, a displaying module 43, a receiving module 44, a polishing module 45, and an audio generating module 46.

The obtaining module 41 is configured to record a user's voice to obtain audio information; the score generating module 42 is connected to the obtaining module 41, and is configured to generate a score curve according to the audio information obtained by the obtaining module 41; the displaying module 43 is connected to the score generating module 42, and is configured to display the score curve generated by the score generating module 42; the receiving module 44 is configured to receive a polishing instruction that is sent by the user by operating the score curve displayed by the displaying module 43; the polishing module 45 is connected to the receiving module 44 and the obtaining module 41, and is configured to adjust the audio information obtained by the obtaining module 41 according to the polishing instruction received by the receiving module 44; and the audio generating module 46 is connected to the polishing module 45, and is configured to generate an audio file according to the audio information adjusted by the polishing module 45.

In an optional implementation manner, the obtaining module 41 is further configured to receive a recording start instruction before recording the user's voice. The obtaining module 41 is specifically configured to record the user's voice according to the recording start instruction. Further, the obtaining module 41 is further configured to receive a recording end instruction after recording the user's voice according to the recording start instruction, and stop recording of the user's voice according to the recording end instruction.

In an optional implementation manner, the receiving module 44 is specifically configured to receive a pitch polishing instruction sent by the user by changing a fluctuation degree of the score curve, where the greater the fluctuation degree of the score curve, the higher a pitch of the audio information. The polishing module 45 is specifically configured to adjust the pitch of the audio information according to the pitch polishing instruction received by the receiving module 44.

In an optional implementation manner, the receiving module 44 is specifically configured to receive an accompaniment polishing instruction that is sent by the user by executing a preset first operation of selecting a start point of accompaniment from the score curve, and receive an accompaniment instrument selection instruction sent by the user, where the accompaniment instrument selection instruction includes information of an accompaniment instrument selected by the user for use. Accordingly, the displaying module 43 is further configured to display, before the receiving module 44 receives the accompaniment instrument selection instruction, information of accompaniment instruments for the user to select the accompaniment instrument for use.

Based on the preceding description, the polishing module 45 is further specifically configured to add, according to the information of the accompaniment instrument selected by the user for use that is received by the receiving module 44 and starting from the selected start point of accompaniment, accompaniment information to the audio information by using a musical scale that corresponds to the accompaniment instrument selected by the user for use.

Figure 5:
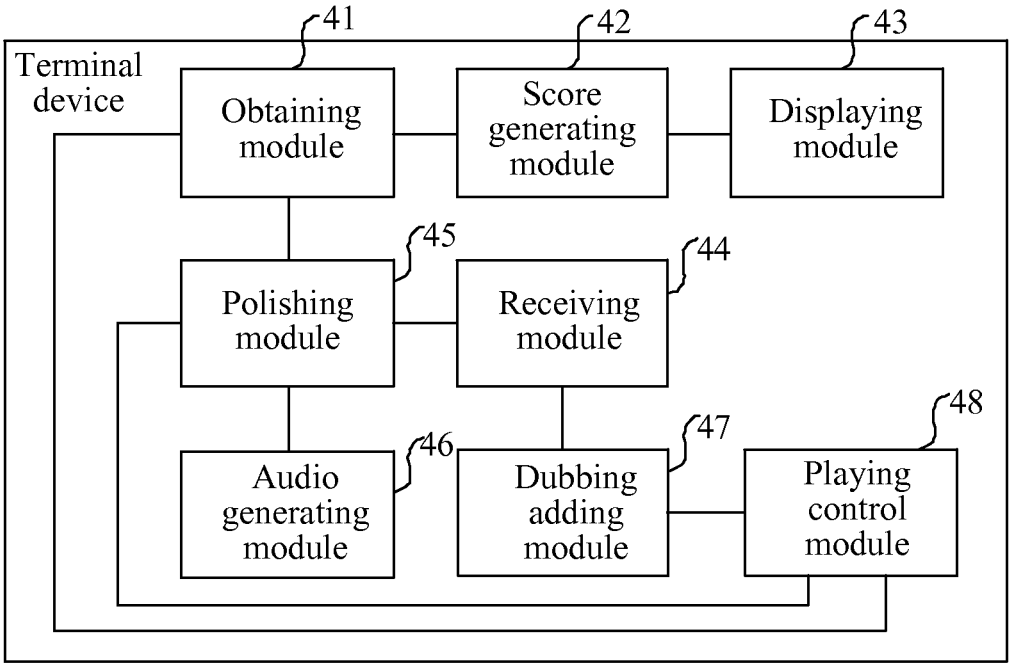
FIG. 5 is a schematic structural diagram of another terminal device according to an embodiment of the present invention.

In an optional implementation manner, the receiving module 44 is further configured to receive, before the audio generating module 46 generates the audio file, a dubbing instruction sent by the user. Based on this, as shown in FIG. 5, the terminal device provided in this embodiment may further include a dubbing adding module 47. The dubbing adding module 47 is connected to the receiving module 44, and is configured to add primitive dubbing information to the audio information according to the dubbing instruction received by the receiving module 44.

In an optional implementation manner, the displaying module 43 is further configured to display an operation icon that corresponds to the audio information after the obtaining module 41 obtains the audio information. As shown in FIG. 5, the terminal device in this embodiment further includes a playing control module 48. The playing control module 48 is connected to the obtaining module 41, and is configured to control, according to an operation performed by the user on the operation icon that is displayed by the displaying module 43, playing of the audio information obtained by the obtaining module 41.

Optionally, the playing control module 48 is further connected to the polishing module 45 and/or the dubbing adding module 47, and is configured to control the playing of the audio information processed by the polishing module 45 and/or the dubbing adding module 47.

Optionally, the playing control module 48 may be specifically configured to control going forward or going backward of a playing position of the audio information according to an operation that the user turns the operation icon; or the playing control module 48 may be specifically configured to control playing or pausing of the audio information according to an operation that the user clicks the operation icon.

In an optional implementation manner, the receiving module 44 is further configured to receive, after the displaying module 43 displays the score curve, a remark adding instruction that is sent by the user by executing a preset second operation of selecting a remark position from the score curve, and receive remark content entered by the user in an input box. The displaying module 43 is further configured to display, after the receiving module 44 receives the remark adding instruction, the input box for the user to enter the remark content.

The terminal device provided in this embodiment may be a handheld device. The handheld device mostly refers to a handheld mobile digital product, including a smart touch-screen mobile phone, a player, a tablet computer, or the like.

Various functional modules of the terminal device provided in this embodiment may be configured to execute a procedure of the methods for producing an audio file according to the preceding embodiments, and no further details about their working principles are provided herein. For details, see the descriptions of the method embodiments.

The terminal device provided in this embodiment obtains audio information by recording a user's voice, generates a score curve that corresponds to the audio information, and displays the score curve while allowing the user to operate the score curve; the user sends a polishing instruction by operating the score curve; the audio information is adjusted according to the polishing instruction sent by the user; and an audio file is generated. This process enables the user to create a song of himself or herself on the terminal device, thereby improving functions of the terminal device and meeting an application requirement of the user. Further, the terminal device provided in this embodiment allows the user to perform various polishing processing for a song produced by himself or herself, so that a more colorful and more individualized song is produced while functions of the terminal device are improved, thereby meeting an application requirement of the user.

Figure 6:
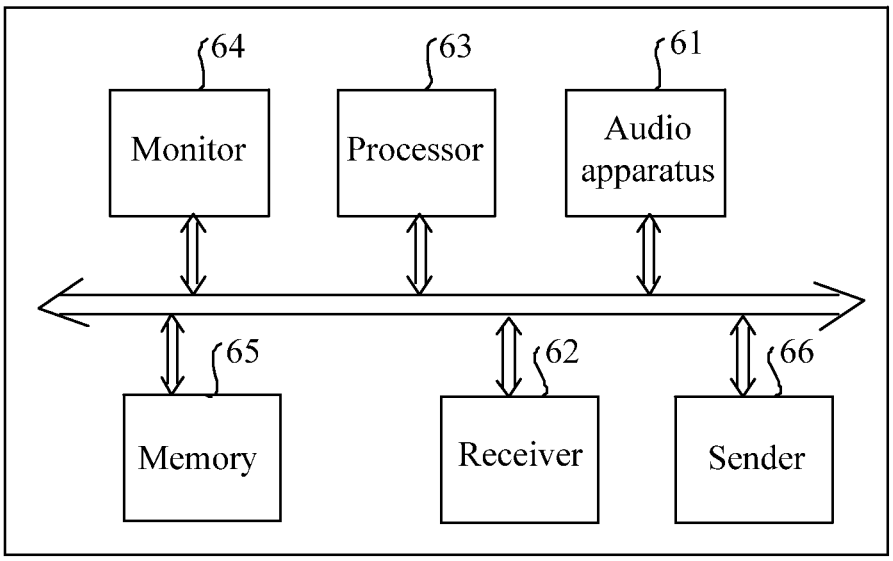
FIG. 6 is a schematic structural diagram of still another terminal device according to an embodiment of the present invention.

FIG. 6 is a schematic structural diagram of still another terminal device according to an embodiment of the present invention. As shown in FIG. 6, the terminal device in this embodiment includes: an audio apparatus 61, a receiver 62, a processor 63, a monitor 64, and a memory 65.

The audio apparatus 61 is configured to record a user's voice to obtain audio information, and provide the processor 63 with the audio information. Optionally, the audio apparatus 61 may start recording of the user's voice according to a recording start instruction received by the receiver 62; and stop recording of the user's voice according to a recording end instruction received by the receiver 62, so as to obtain the audio information.

The monitor 64 is configured to display a score curve provided by the processor 63.

The receiver 62 is configured to receive a polishing instruction that is sent by the user by operating the score curve displayed on the monitor 64, and provide the processor 63 with the polishing instruction.

The memory 65 is mostly configured to store a program. Specifically, the program may include program codes, and the program codes include a computer operation instruction. The memory 65 may include a high-speed RAM, or may further include a non-volatile memory (non-volatile memory), such as at least one disk memory.

The processor 63 is configured to execute the program stored in the memory 65, so as to generate the score curve according to the audio information recorded by the audio apparatus 61 and provide the monitor 64 with the score curve; adjust the audio information recorded by the audio apparatus 61 according to the polishing instruction provided by the receiver 62; and generate an audio file according to the adjusted audio information. Accordingly, the memory 65 may be further configured to store the audio file generated by the memory 63.

The processor 63 may be a central processing unit (CPU), or an application specific integrated circuit (ASIC), or one or more integrated circuits configured to implement the embodiment of the present invention.

Optionally, the audio apparatus 61, the receiver 62, the processor 63, the monitor 64, and the memory 65 may be independently implemented. Then the audio apparatus 61, the receiver 62, the processor 63, the monitor 64, and the memory 65 may be connected to each other by using a bus and communicate with each other. The bus may be an industry standard architecture (ISA) bus, a peripheral component interconnection (PCI) bus, or an extended industry standard architecture (EISA) bus, or the like. The bus may be divided into an address bus, a data bus, a control bus, or the like. For ease of expression, only one bold line is used in FIG. 6 for expression but this does not mean that there is only one bus or one type of bus.

Optionally, the audio apparatus 61, the receiver 62, the processor 63, the monitor 64, and the memory 65 may be integrated in one chip. Then the audio apparatus 61, the receiver 62, the processor 63, the monitor 64, and the memory 65 may communicate with each other by using internal interfaces.

Further, the terminal device in this embodiment may further include a sender 66. The sender 66 is configured to send the audio file generated by the processor 63 to another device.

The terminal device provided in this embodiment may be a handheld device. The handheld device mostly refers to a handheld mobile digital product, including a smart touch-screen mobile phone, a player, a tablet computer, or the like.

The terminal device provided in this embodiment may be configured to execute a procedure of the methods for producing an audio file according to the preceding embodiments, and no further details about its working principles are provided herein. For details, see the descriptions of the method embodiments.

The terminal device provided in this embodiment obtains audio information by recording a user's voice, generates a score curve that corresponds to the audio information, and displays the score curve while allowing the user to operate the score curve; the user sends a polishing instruction by operating the score curve; the audio information is adjusted according to the polishing instruction sent by the user; and an audio file is generated. This process enables the user to create a song of himself or herself on the terminal device, thereby improving functions of the terminal device and meeting an application requirement of the user. Further, the terminal device provided in this embodiment allows the user to perform various polishing processing for a song produced by himself or herself, so that a more colorful and more individualized song is produced while functions of the terminal device are improved, thereby meeting an application requirement of the user.

A person of ordinary skill in the art may understand that all or a part of the steps of the foregoing method embodiments may be implemented by a program instructing relevant hardware. The aforementioned program may be stored in a computer readable storage medium. When the program runs, the steps of the foregoing method embodiments are performed. The foregoing storage medium includes any medium capable of storing program codes, such as a ROM, a RAM, a magnetic disk, or an optical disk.

Finally, it should be noted that the foregoing embodiments are merely intended for describing the technical solutions of the present invention other than limiting the present invention. Although the present invention is described in detail with reference to the foregoing embodiments, persons of ordinary skill in the art should understand that they may still make modifications to the technical solutions described in the foregoing embodiments, or make equivalent replacements to some or all the technical features thereof; such modifications or replacements do not make the essence of corresponding technical solutions depart from the scope of the technical solutions of the embodiments of the present invention.

What is claimed is:

1. A method for producing an audio file, comprising:

recording a user's voice to obtain audio information;

generating a score curve according to the audio information, and displaying the score curve;

receiving a polishing instruction that is sent by the user by operating the score curve; and adjusting the audio information according to the polishing instruction, and generating the audio file according to the adjusted audio information;

wherein receiving the polishing instruction that is sent by the user by operating the score curve and adjusting the audio information according to the polishing instruction are implemented according to a first procedure, a second procedure, or a third procedure;

wherein the first procedure comprises:

receiving a pitch polishing instruction that is sent by the user by changing a variation of an excursion of the score curve, wherein a greater excursion of the score curve results in a higher pitch of the audio information; and adjusting the pitch of the audio information according to the pitch polishing instruction;

wherein the second procedure comprises:

receiving an accompaniment polishing instruction that is sent by the user by executing a preset first operation of selecting a start point of accompaniment from the score curve;

displaying information of a plurality of accompaniment instruments for the user to select an accompaniment instrument for use;

receiving an accompaniment instrument selection instruction sent by the user; wherein the accompaniment instrument selection instruction comprises information of the accompaniment instrument selected by the user for use; and adding, starting from the selected start point of accompaniment and according to the information of the accompaniment instrument selected by the user for use, accompaniment information to the audio information by using a musical scale that corresponds to the accompaniment instrument selected by the user for use;

wherein the third procedure comprises:

receiving a rhythm polishing instruction that is sent by the user by changing a bandwidth or evenness of the score curve; and adjusting the rhythm of the audio information according to the rhythm polishing instruction.

2. The method for producing the audio file according to claim 1, wherein, before the recording the user's voice, the method further comprises: receiving a recording start instruction; and the recording the user's voice comprises: recording the user's voice according to the recording start instruction; and after the recording the user's voice according to the recording start instruction, the method further comprises: receiving a recording end instruction, and ending recording of the user's voice according to the recording end instruction.

3. The method for producing the audio file according to claim 1, wherein, before the generating the audio file according to the adjusted audio information, the method comprises:

receiving a dubbing instruction sent by the user; and adding primitive dubbing information to the audio information according to the dubbing instruction.

4. The method for producing the audio file according to claim 1, wherein, after the recording the user's voice to obtain audio information, the method further comprises:

displaying an operation icon that corresponds to the audio information; and performing playing control on the audio information according to an operation performed by the user on the operation icon.

5. The method for producing the audio file according to claim 4, wherein the performing playing control on the audio information according to the operation performed by the user on the operation icon comprises:

controlling going forward or going backward of a playing position of the audio information according to an operation that the user turns the operation icon.

6. The method for producing the audio file according to claim 4, wherein the performing playing control on the audio information according to the operation performed by the user on the operation icon comprises:

controlling playing or pausing of the audio information according to an operation that the user clicks the operation icon.

7. The method for producing the audio file according to claim 1, wherein, after the generating the score curve according to the audio information, and displaying the score curve, the method further comprises:

receiving a remark adding instruction that is sent by the user by executing a preset second operation of selecting a remark position from the score curve;

displaying an input box for the user to enter remark content; and receiving the remark content entered by the user in the input box.

8. The method according to claim 1, wherein receiving the polishing instruction that is sent by the user by operating the score curve and adjusting the audio information according to the polishing instruction are implemented according to the first procedure.

9. The method according to claim 1, wherein receiving the polishing instruction that is sent by the user by operating the score curve and adjusting the audio information according to the polishing instruction are implemented according to the second procedure.

10. The method according to claim 1, wherein receiving the polishing instruction that is sent by the user by operating the score curve and adjusting the audio information according to the polishing instruction are implemented according to the third procedure.

11. A terminal device, comprising:

a processor; and a computer-readable storage medium storing a program to be executed by the processor, the program including instructions for:

recording a user's voice to obtain audio information;

generating a score curve according to the audio information;

displaying the score curve;

receiving a polishing instruction that is sent by the user by operating the score curve;

adjusting the audio information according to the polishing instruction; and generating an audio file according to the adjusted audio information;

wherein instructions for receiving the polishing instruction that is sent by the user by operating the score curve and adjusting the audio information according to the polishing instruction comprise a first set of instructions, a second set of instructions, or a third set of instructions;

wherein the first set of instructions comprises instructions for:

receiving a pitch polishing instruction that is sent by the user by changing a variation of an excursion of the score curve, wherein a greater excursion of the score curve results in a higher pitch of the audio information; and adjusting the pitch of the audio information according to the pitch polishing instruction:

wherein the second set of instructions comprises instructions for:

receiving an accompaniment polishing instruction that is sent by the user by executing a preset first operation of selecting a start point of accompaniment from the score curve;

displaying information of a plurality of accompaniment instruments for the user to select an accompaniment instrument for use;

receiving an accompaniment instrument selection instruction sent by the user, wherein the accompaniment instrument selection instruction comprises information of the accompaniment instrument selected by the user for use; and adding, starting from the selected start point of accompaniment and according to the information of the accompaniment instrument selected by the user for use, accompaniment information to the audio information by using a musical scale that corresponds to the accompaniment instrument selected by the user for use;

wherein the third set of instructions comprises instructions for:

receiving a rhythm polishing instruction that is sent by the user by changing a bandwidth or evenness of the score curve; and adjusting the rhythm of the audio information according to the rhythm polishing instruction.

12. The terminal device according to claim 11, wherein the program further includes instructions for receiving a recording start instruction before recording the user's voice; and receiving a recording end instruction after recording the user's voice, and stopping recording of the user's voice according to the recording end instruction.

13. The terminal device according to claim 11, wherein the program further includes instructions for receiving, before generating the audio file, a dubbing instruction sent by the user; and adding primitive dubbing information to the audio information according to the dubbing instruction.

14. The terminal device according to claim 11, wherein the program further includes instructions for displaying an operation icon that corresponds to the audio information after obtaining the audio information; and performing playing control on the audio information according to an operation performed by the user on the operation icon.

15. The terminal device according to claim 14, wherein performing playing control comprises going forward or going backward of a playing position of the audio information according to an operation that the user turns the operation icon.

16. The terminal device according to claim 14, wherein performing playing control comprises controlling playing or pausing of the audio information according to an operation that the user clicks the operation icon.

17. The terminal device according to claim 11, wherein the program further includes instructions for receiving, after displaying the score curve, a remark adding instruction that is sent by the user by executing a preset second operation of selecting a remark position from the score curve, and receive remark content entered by the user in an input box; and displaying the input box for the user to enter the remark content.

18. The terminal device according to claim 11, wherein the instructions for receiving the polishing instruction that is sent by the user by operating the score curve and adjusting the audio information according to the polishing instruction comprise the first set of instructions.

19. The terminal device according to claim 11, wherein the instructions for receiving the polishing instruction that is sent by the user by operating the score curve and adjusting the audio information according to the polishing instruction comprise the second set of instructions.

20. The terminal device according to claim 11, wherein the instructions for receiving the polishing instruction that is sent by the user by operating the score curve and adjusting the audio information according to the polishing instruction comprise the third set of instructions.

* * * * *